US008336348B2

(12) United States Patent
Dalton, Jr. et al.

(10) Patent No.: US 8,336,348 B2
(45) Date of Patent: Dec. 25, 2012

(54) KEY OPERATED PIN TUMBLER LOCKS AND METHODOLOGY

(75) Inventors: Robert E. Dalton, Jr., Mauldin, SC (US); Glyn A. Finch, Jr., Simpsonville, SC (US)

(73) Assignee: CompX International Inc., Greenville, SC (US)

( * ) Notice: Subject to any disclaimer, the term of this patent is extended or adjusted under 35 U.S.C. 154(b) by 1286 days.

(21) Appl. No.: 11/805,721

(22) Filed: May 24, 2007

(65) Prior Publication Data

US 2007/0271976 A1 Nov. 29, 2007

Related U.S. Application Data

(60) Provisional application No. 60/808,742, filed on May 26, 2006.

(51) Int. Cl.
*E05B 35/08* (2006.01)

(52) U.S. Cl. ..... 70/337; 70/340; 70/367

(58) Field of Classification Search ..... 70/337, 70/367, 369, 340, 341, 342
See application file for complete search history.

(56) References Cited

U.S. PATENT DOCUMENTS

| | | | | | |
|---|---|---|---|---|---|
| 2,814,941 | A | | 12/1957 | Best | |
| 3,206,958 | A | | 9/1965 | Best | |
| 3,261,189 | A | * | 7/1966 | Best | 70/369 |
| 3,324,693 | A | | 6/1967 | Check | |
| 3,603,123 | A | | 9/1971 | Best | |
| 4,085,601 | A | | 4/1978 | Sauder | |
| 4,282,731 | A | | 8/1981 | Taksony | |
| 4,328,690 | A | | 5/1982 | Oliver | |
| 4,386,510 | A | | 6/1983 | Best et al. | |
| 4,424,693 | A | | 1/1984 | Best et al. | |
| 4,444,029 | A | | 4/1984 | Remington | |
| 4,584,855 | A | | 4/1986 | Burlingame | |
| 4,866,964 | A | | 9/1989 | Hall | |
| 4,953,373 | A | * | 9/1990 | Toledano | 70/369 |
| 4,972,695 | A | | 11/1990 | Mochida et al. | |
| 5,070,715 | A | | 12/1991 | Smallegan et al. | |
| 5,138,856 | A | | 8/1992 | Chyun | |
| 5,176,015 | A | | 1/1993 | Sussina | |
| 5,209,087 | A | | 5/1993 | Cox | |
| 5,431,034 | A | * | 7/1995 | Fann et al. | 70/369 |
| 5,813,260 | A | * | 9/1998 | Widen | 70/369 |
| 5,907,963 | A | | 6/1999 | Myers et al. | |
| 5,964,110 | A | * | 10/1999 | Crocco et al. | 70/369 |
| 5,979,200 | A | | 11/1999 | Cliff | |
| 6,012,311 | A | | 1/2000 | Duckwall | |
| 6,035,673 | A | * | 3/2000 | Harrison | 70/369 |
| 6,382,006 | B1 | | 5/2002 | Field et al. | |
| 6,526,791 | B2 | | 3/2003 | Shvarts | |
| 6,578,396 | B2 | | 6/2003 | Field et al. | |
| 6,679,090 | B1 | | 1/2004 | Finch, Jr. | |

* cited by examiner

*Primary Examiner* — Christopher Boswell
(74) *Attorney, Agent, or Firm* — Dority & Manning, P.A.

(57) ABSTRACT

Apparatus and associated methodology are provided for key operated pin tumbler locks, some of which may incorporate a removable core pin tumbler lock. A selected tumbler of a type commonly used in pin tumbler locks is configured along with a driver pin to control operation of a retainer that, when rotated by use of a control key inserted in the lock, allows alternate selective removal and replacement of the core assembly in the lock. Also, or separate therefrom, one or more tumbler holes may be formed or drilled in a manner so as to prevent engagement of a tumbler with the bite of a key. Presently disclosed structures and associated methodology help to reduce any susceptibility to unauthorized techniques practiced against the lock, such as unintentional activation of the tumblers by unauthorized persons through use of a key with so-called "bumping" techniques.

15 Claims, 5 Drawing Sheets

KEY OPERATED PIN TUMBLER LOCKS AND METHODOLOGY

PRIORITY CLAIM

This application claims the benefit of previously filed U.S. Provisional Patent Application entitled "KEY OPERATED PIN TUMBLER LOCKS AND METHODOLOGIES," assigned U.S. Ser. No. 60/808,742, filed May 26, 2006, and which is incorporated herein by reference for all purposes.

FIELD OF THE INVENTION

The present subject matter relates to key operated pin tumbler locks and related methodology. More particularly, in some instances, the present subject matter relates to pin tumbler locks and related methodology involving a removable core assembly that allows changing of an associated operative key without having to remove or uninstall a mounted lock. In other instances, the present subject matter relates to pin tumbler locks and associated methodology involving a core assembly that is fabricated with a variable pin tumbler drilling depth feature. In either instance, pin tumbler locks are provided which have relatively improved security against unauthorized access to operation of associated lock features.

BACKGROUND OF THE INVENTION

In the field of office maintenance, and in other settings and environments, it is a common practice to replace locks used for drawers and/or doors as a security measure. Such replacements and/or changes may be part of an ongoing, periodic security maintenance plan, and/or the changes may be a result of more ad hoc circumstances, for example, accompanying a change in authorized personnel. Improving the security functionality of the associated locks would be one way to address such security needs. Another way to address such security needs could involve use of so-called removable core locks, for literally changing out the core lock functionality such that an entirely different key becomes operable with the lock. The present subject matter addresses both such approaches to lock security maintenance improvement.

Normally, changing or replacing locks can take extended periods of time unless removable core locks are employed. In general, the basic concept of providing removable core locks has been available for a period of time, and the use of such locks in general may significantly reduce (literally from hours to minutes) the time required to change locks for which re-keying is desired. However, embodiments of previously known removable core locks are often mechanically complex. In general, the more mechanically complex a device, the higher its cost, the larger its size, and the more questionable its reliability may tend to be. In view of such general disadvantages of many previously available removable core locks, it would be an advance in the art to provide a lock and associated methodology which resulted with a reduced part count that also required less precision to align the parts during assembly.

Another potential vulnerability of some key operated pin tumbler lock designs involves an unauthorized practice where there is unintentional activation of the tumbler by a key. For example, in some situations, it may be possible for an unauthorized person to use a modified key partially inserted and then manipulated or "bumped" in a particular manner, as an effort to cause spring-biased tumblers to very temporarily be displaced to an extent that either the lock itself or some removable core portion of a removable core lock may be actuated, thus permitting access by an unauthorized person. It would be an advance in the art to provide a key operated pin tumbler lock and associated methodology which was less potentially susceptible to such unintentional activation of the tumbler by a key by unauthorized persons.

Existing patent literature has previously addressed various pin tumbler lock arrangements and various removable core lock arrangements for pin tumbler locks. Some examples of issued patents include U.S. Pat. No. 6,679,090; U.S. Pat. No. 6,578,396; U.S. Pat. No. 6,526,791; U.S. Pat. No. 6,382,006; U.S. Pat. No. 6,012,311; U.S. Pat. No. 5,979,200; U.S. Pat. No. 5,907,963; U.S. Pat. No. 5,209,087; U.S. Pat. No. 5,176,015; U.S. Pat. No. 5,138,856; U.S. Pat. No. 5,070,715; U.S. Pat. No. 4,972,695; U.S. Pat. No. 4,866,964; U.S. Pat. No. 4,584,855; U.S. Pat. No. 4,444,029; U.S. Pat. No. 4,424,693; U.S. Pat. No. 4,386,510; U.S. Pat. No. 4,328,690; U.S. Pat. No. 4,282,731; U.S. Pat. No. 4,085,601; U.S. Pat. No. 3,603,123; U.S. Pat. No. 3,324,693; U.S. Pat. No. 3,206,958; and U.S. Pat. No. 2,814,941. The disclosures of all the foregoing published patents are for all purposes fully incorporated herein by reference.

While various implementations of key operated pin tumbler locks and related methodology, both involving and not involving removable core locks, have been developed, no design has emerged that generally encompasses all of the desired characteristics as hereafter presented in accordance with the present subject matter.

SUMMARY OF THE INVENTION

In view of the recognized features encountered in the prior art and addressed by the present subject matter, it is a general present object to provide an improved apparatus and methodology for key operated pin tumbler type locks. More particularly, it is a present object to provide improved such locks, for improved security functionality in a variety of settings, conditions and uses.

More particularly, it is a present object to provide improved such locks, regardless of whether they are configured as a removable core lock.

Still further, it is a present object to provide improved such locks, configured as a removable core lock, but with relatively reduced mechanical complexity, for corresponding improvement obtained through generally reduced cost, reduced size, and greater reliability.

Yet further, it is a general present object to provide an improved apparatus and methodology for key operated pin tumbler type locks, which resultantly are less susceptible to so-called access or penetration by unauthorized persons, such as by unintentional activation of a tumbler by a key.

In an exemplary configuration associated with removable core assemble embodiments, a control key is provided that allows removal of a core assembly from an outer cylinder of a lock, to facilitate re-keying of the lock.

In one of its simpler forms, a single, predetermined tumbler is configured to allow limited rotation of a locking tab that, when in an unlocked position, permits removal of such core assembly in such exemplary embodiments.

A positive aspect of the removable core pin tumbler lock embodiments constructed in accordance with the present technology is that the lock must first be placed in an unlocked position before the control key can be used to remove the core assembly.

In accordance with aspects of certain embodiments of the present subject matter, a lock structure is provided that can not be unlocked by use of the control key only but first must be unlocked by a pass or master key.

In accordance with certain aspects of other embodiments of the present subject matter, methodologies have been developed to insure that no keys embodied as pass or master keys can be re-cut to allow it to operate as a control key.

In one exemplary present embodiment, a key operated removable core pin tumbler lock is provided, having a core, a first cylinder, and a locking tab. In such exemplary embodiment, the core is preferably configured to receive first and second key types, such core being provided with a first plurality of holes configured to receive pin tumblers. Such exemplary first cylinder is preferably configured to receive such core and provided with a second plurality of holes configured to receive pin tumblers. Such second plurality of holes are preferably equal in number and alignable with the first plurality of holes. Further, such first cylinder preferably comprises a first portion and a second portion, with such second portion configured for limited rotation with respect to the first portion thereof and provided with at least one hole of the second plurality of holes. Such exemplary locking tab preferably extends from a portion of the second portion of the first cylinder. With such exemplary embodiment, advantageously, insertion of the first key type permits unlocking of the lock, while insertion of the second key type permits rotation of the second portion of the first cylinder with respect to the first portion of the first cylinder.

In another present exemplary embodiment, a multiple key type actuated removable core pin tumbler lock assembly is provided, including a configuration of a core, a first cylinder, a locking tab, and a second cylinder. In such exemplary embodiment, such core may be configured to receive first and second key types. Such first cylinder may comprise a first portion and a second portion, with such first and second portions being rotatable relative to each other, and with such core and such first cylinder defining respective pluralities of mutually alignable pin tumbler receiving holes. Such exemplary locking tab preferably extends from a portion of the second portion of the first cylinder. In such exemplary embodiment, the second cylinder may be configured to retainably receive the first cylinder. Advantageously, the second portion of the first cylinder forms at least one pin tumbler receiving hole thereof alignable with at least one pin tumbler receiving hole formed in the core, such that insertion of the first key type into such core permits unlocking of the lock while insertion of the second key type into the core permits rotation of the locking tab.

In yet another present exemplary embodiment, a key operated pin tumbler lock has a pin tumbler variable depth feature, for improved security against unauthorized access to operation thereof. Such present exemplary lock preferably includes a core, a first cylinder, a plurality of sets of paired pin tumblers and driver pin sets, and plurality of biasing springs. Such exemplary core may form a first plurality of holes configured to receive pin tumblers. Such exemplary first cylinder may be configured to receive such core and provided with a second plurality of holes configured to receive respective sets of paired pin tumblers and driver pin sets, with such second plurality of holes being equal in number and alignable with the first plurality of holes. Such plurality of sets of paired pin tumblers and driver pin sets may be respectively received in the second plurality of holes. The plurality of biasing springs are preferably received respectively in the second plurality of holes, and configured for driving the respective sets of paired pin tumblers and driver pin sets into the first plurality of holes when aligned with the second plurality of holes. In such instance, a sheer line is defined by the relative resting position of the meeting point between respective pin tumblers and driver pins of a given pair thereof.

In the foregoing exemplary embodiment, preferably at least one hole of the first plurality of holes is formed to a predetermined depth selected such that the bottom of the corresponding pin tumbler is relatively displaced, so as to avoid contact of such corresponding pin tumbler with a key of a given type inserted into such lock.

It is to be further understood that the present subject matter equally relates to and encompasses corresponding methodologies, one non-limiting example of which relates to a method for providing a removable core lock, including the steps of providing a lock core; providing a first cylinder comprising first and second portions; providing a locking tab on a portion of the second portion; configuring the second portion to be rotatable relative to the first portion; inserting the lock core into the first cylinder; providing a plurality of alignable tumbler receiving holes in the lock core and the first portion of the first cylinder; and providing at least one alignable hole in the lock core and the second portion of the first cylinder.

Additional objects and advantages of the present subject matter are set forth in, or will be apparent to, those of ordinary skill in the art from the detailed description herein. Also, it should be further appreciated that modifications and variations to the specifically illustrated, referenced, and/or discussed features, elements, and/or steps hereof may be practiced in various embodiments and uses of the present subject matter without departing from the spirit and scope of the present subject matter. Exemplary such variations may include, but are not limited to, substitution of equivalent means, features, or steps for those illustrated, referenced, or discussed, and the functional, operational, and/or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures).

Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
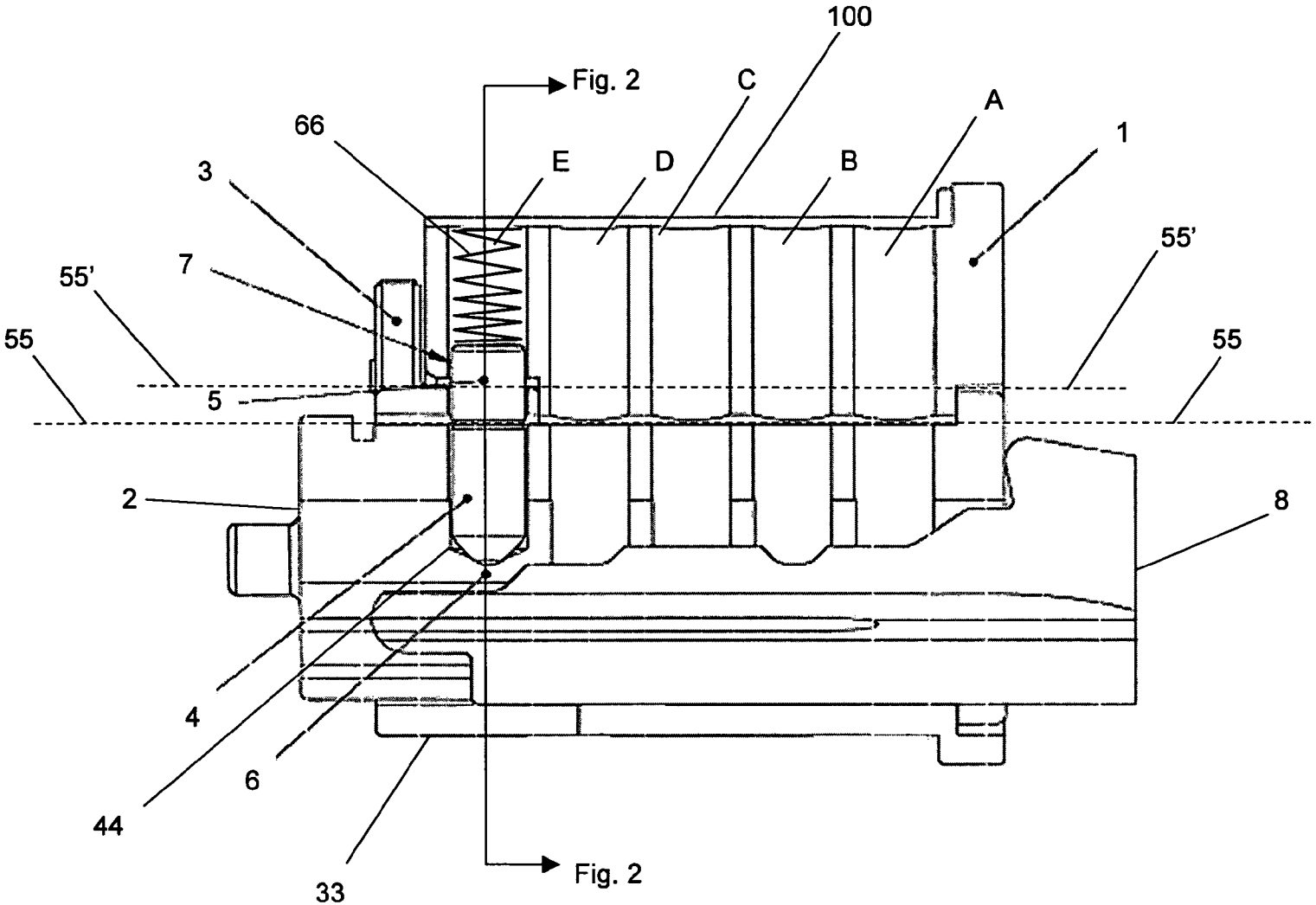
FIG. 1 is a longitudinally oriented cross-sectional view of a present exemplary pin tumbler lock core assembly, illustrating a so-called pass key inserted therein, which core assembly may be removable in accordance with the present subject matter.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with pin tumbler locks which are key operated, and which in some present embodiments are configured for having a removable core assembly that allows changing of an associated key without having to remove or uninstall a mounted lock.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned but which perform the same or similar function.

Reference will now be made in detail to the presently preferred embodiments of the subject key operated pin tumbler lock and associated methodology.

With reference to the drawings, FIG. 1 is a longitudinally oriented cross-sectional view of selected portions of a present exemplary pin tumbler lock core assembly 100 constructed in accordance with the present technology, which core assembly in some embodiments may be removable in accordance with the present subject matter. It should be well understood by those of ordinary skill in the art that for various present embodiments, FIG. 1 is also representative of a present exemplary pin tumbler lock core assembly 100 constructed in accordance with the present technology, but which core assembly in accordance with the present subject matter is not necessarily of a readily removable nature.

FIG. 1 also representatively illustrates a so-called pass key, such as pass key 8, illustrated as inserted into the core assembly 100. Core assembly 100 may preferably comprise an inner cylinder 1 and a core 2, together with additional components as will be described more fully below with reference FIG. 4B.

Figure 5B:
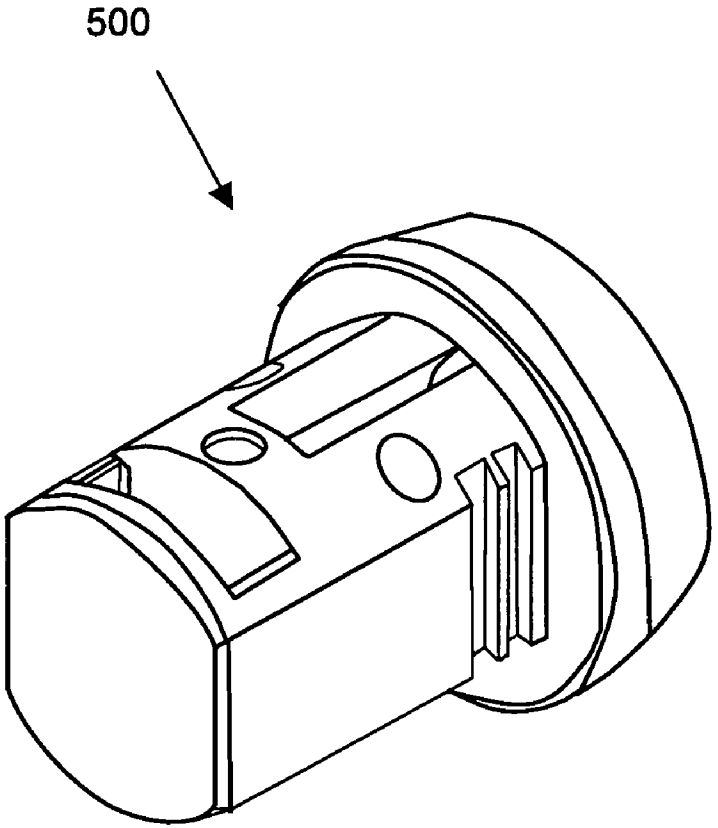
FIGS. 5A and 5B are respective front and back (and generally side) perspective views of an exemplary outer cylinder into which a present exemplary core assembly may be installed in accordance with the present subject matter.
Figure 5A:
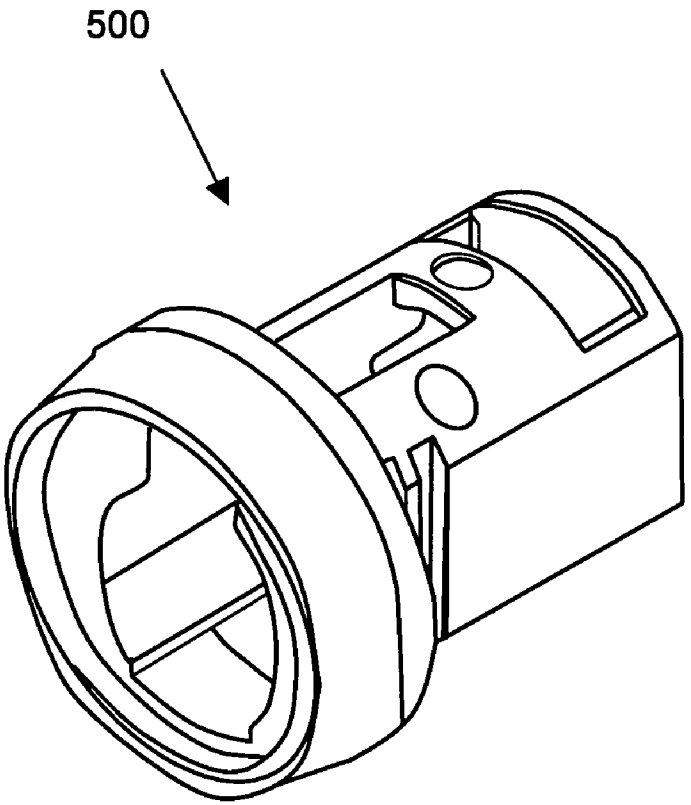
Figure 6:
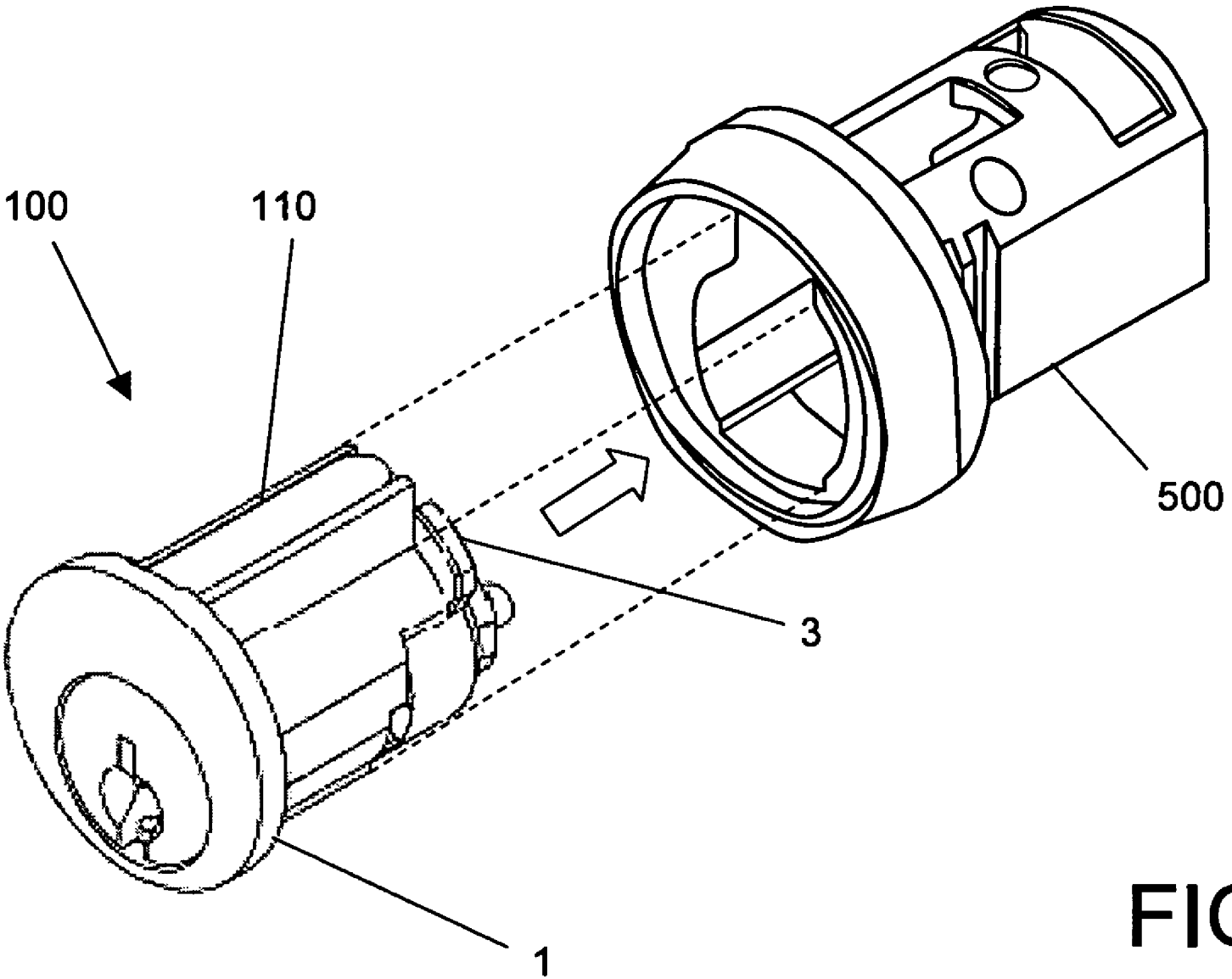
FIG. 6 illustrates methodology for insertion of a present exemplary inner cylinder and core assembly into an exemplary outer cylinder, in a present removable core assembly embodiment, to effect re-keying of a lock.

With further reference to FIG. 1, when a present pin tumbler lock constructed in accordance with the present technology is provided with a removable core, an element such as exemplary locking tab 3 may be utilized as an extension of a supporting cylindrical retainer 33 of the core 2. Such locking tab 3 may be normally held in place such as by a driver pin 5. When such occurs, locking tab 3 and retainer 33 are prevented from rotating, which correspondingly prevents core assembly 100 from being removed from an outer cylinder 500 (see FIGS. 5A and 5B). FIGS. 5A and 5B are respective front and back (and generally side) perspective views of such exemplary outer cylinder 500 into which a present exemplary core assembly generally 100 may be installed in accordance with the present subject matter. Such exemplary core assembly 100 is removed from outer cylinder 500 as it is illustrated in FIGS. 5A and 5B, while FIG. 6 illustrates exemplary insertion of an exemplary core assembly 100 into present outer cylinder 500, to effect lock re-keying.

In accordance with one aspect of the current technology, tumbler 4 is normally held in a position determined by the depth of a hole 44 drilled in core or plug 2 and is forced down into such hole 44 by spring 66 positioned above driver pin 5. The force provided by spring 66 on driver pin 5 correspondingly forces tumbler 4 down against the bottom of the hole 44. The pass key 8, by way of its being bitted 6 so as not to touch tumbler 4, cannot accidentally dislodge tumbler 4 and driver pin 5, thereby inadvertently permitting the core assembly to be removed.

In accordance with the present technology, the designated top of tumbler 4 is held at shear line 55 by the depth of hole 44, thus allowing the core 2 to be rotated when a proper pass or access key 8 is inserted. As will be apparent to those of ordinary skill in the art, insertion of a pass or access key would align to the shear line 55 all of the tumblers in the lock (none of which other than tumble 4 are presently illustrated) so that the lock may be opened. One aspect of the present subject matter can be seen in the fact that tumbler 4, in this exemplary embodiment controlling movement of tab 3, is normally held at shear line 55 due to the depth of hole 44 and downward pressure of spring 66 on driver pin 5, even if no key is inserted into the lock.

Tumbler 4 and driver pin 5 are standard components that have been used in lock making for years. The present technology allows the use of such readily available components in a way that has not been previously employed to thereby avoid the use of special components, such as so-called master wafers and/or other mechanically contrived mechanisms previously employed that, due to their complex nature, might fail. The present technology, therefore, is able to provide a simple, cost effective and reliable removable core pin tumbler lock not previously available.

Figure 2A:
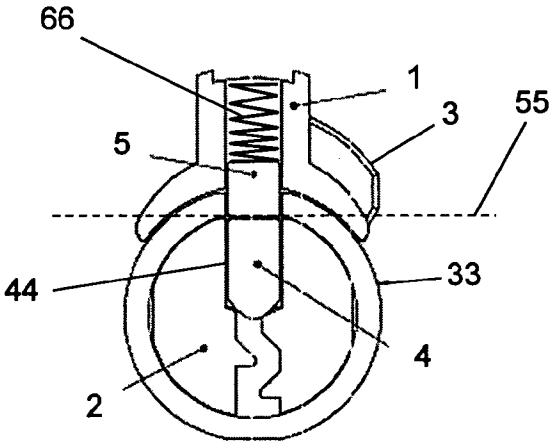
FIG. 2A is a further cross-sectioned view, taken along the section line FIG. 2-FIG. 2 as illustrated in FIG. 1, of the exemplary core assembly of present FIG. 1, in a locked or non-removable position thereof.
Figure 2B:
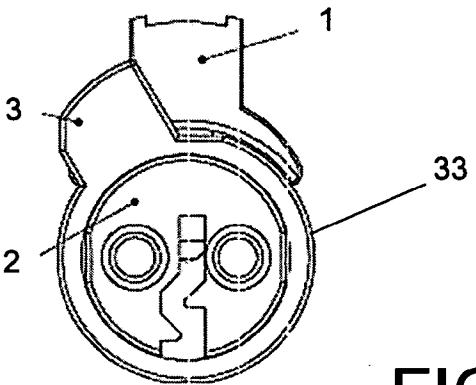
FIG. 2B is a back end view of the exemplary core assembly of present FIGS. 1 and 2A, also illustrated as in a locked or non-removable position thereof.

With reference now to FIGS. 2A, 2B, 3A, and 3B there are illustrated, respectively, an internal cross-section (FIG. 2A) and a rear view (FIG. 2B) of the core assembly 100 in a locked (i.e. core non-removable) position and an internal cross-section (FIG. 3A) and a rear view (FIG. 3B) of the core assembly 100 in an un-locked (i.e., core removable) position. As previously mentioned, in normal operation, spring 66 pushes driver pin 5 down against tumbler 4 and seats tumbler 4 against the bottom of hole 44 in core 2. As illustrated in FIG. 2B, locking tab 3, when held in the position shown, prohibits the core assembly 100 from being removed from the outer cylinder due to the locking tab 3's rotated position relative to inner and outer cylinders.

Other embodiments of the present subject matter may be practiced. For example, the subject matter of present FIG. 1, as illustrated, generally tends to address the susceptibility of pin tumbler lock arrangements to unintentional activation of the tumbler by a key used by unauthorized persons, whether a removable core is involved or not. Also, variations may be practiced even among the components illustrated. For example, while the hole/tumbler/drive pin/spring arrangement as discussed above is illustrated in conjunction with a position E formed relative to an inner cylinder 1 and a core 2, such component arrangements may be practiced at other positions A, B, C, and/or D relative to an inner cylinder 1 and a core 2, as illustrated. It is also to be understood that any one or more of positions A through E, inclusive, may be provided with a hole (such as or similar to hole 44), or provided with a hole which although similar in some respects, is otherwise formed (i.e., drilled) to its own particular depth or level, for purposes of particular embodiments. In various embodiments, some not necessarily involving a removable core cylinder, the tumbler hole may be formed/drilled to a relatively shallow depth, in any one or more of the illustrated positions A through E, to stop a particular key from functioning with the associated tumbler of such tumbler hole.

Stated another way, the present subject matter includes and encompasses the methodology (and corresponding resulting structure) or selecting one or more tumbler positions for forming/drilling a tumbler hole associated respectively therewith, so as to situated in a relatively shallow position within core or plug 2. Such configurations correspondingly place the involved tumbler or tumblers in relatively elevated positions in relation to a particular key, which particular key or keys can not even touch the associated tumbler. However, in accordance with present subject matter, a properly bitted key (i.e., one with an adequately shallow bite), could touch the tumbler or tumblers, and therefore actuate the associated lock or otherwise cause it to function. As noted above, such arrangements can provide advantages regardless of whether used in a key operated pin tumbler embodiment with a removable core or not. Stated yet another way, the concept disclosed herein could also be used in any tumbler position to thwart the use of picking tools by varying the resting position of tumblers.

Figure 3A:
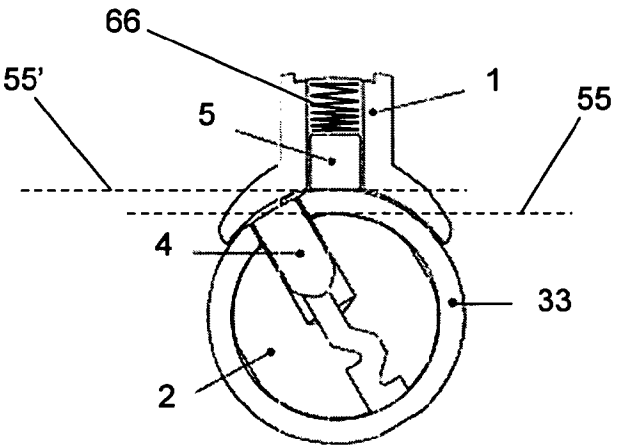
FIG. 3A is a further cross-sectioned view, taken along the section line FIG. 2-FIG. 2 as illustrated in FIG. 1, of the exemplary core assembly of present FIG. 1, in an unlocked or removable position thereof.
Figure 3B:
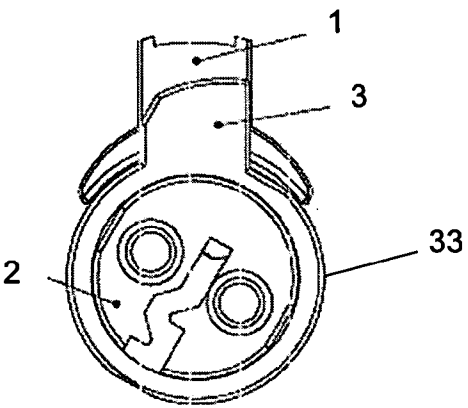
FIG. 3B is a back end view, similar to that of FIG. 2B, of the exemplary core assembly of present FIGS. 1 through 3A, and also illustrated as in an unlocked or removable position thereof.

FIG. 3B illustrates locking tab 3 rotated to a removal or un-locked position of a removable core. Locking tab 3 in the illustration of FIG. 3B (as contrasted with that of FIG. 3A) has been aligned with the tumbler block of the inner cylinder 1, thus in such particular embodiment, enabling removal of the core assembly 100. FIG. 2A shows the driver pin 5 preventing rotation of the retainer 33 and locking tab 3. FIG. 3A illustrates the position of tumbler 4 moved to shear line 55' when a removal or control key 8 is inserted in the lock. The key biting (i.e., profile) literally moves, or raises, tumbler 4 and driver pin 5 so that driver pin 5 engages retainer 33, and the driver pin 5 bottom is then at the retainer shear line 55'. The removal or control key 8 can then be used to rotate the core assembly to the removal position to allow removal of the core assembly 100, as will be understood by those of ordinary skill in the art upon reviewing the present figures and disclosure materials.

Figures 4A, 4B:
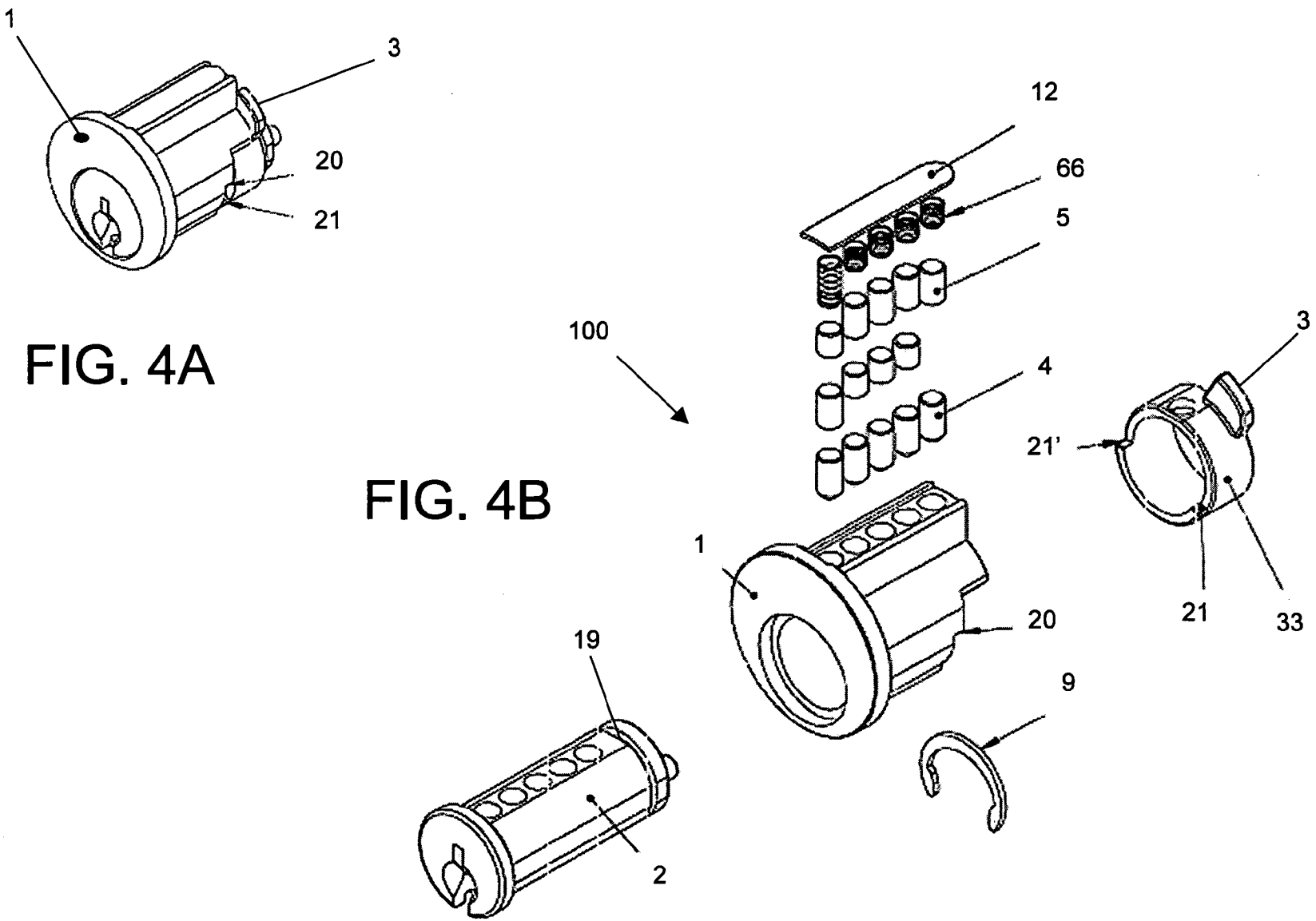
FIG. 4A illustrates a generally front and side perspective or isometric view of a present exemplary core assembly in isolation and in an assembled condition thereof.
FIG. 4B illustrates an exploded view of the exemplary core assembly of present FIG. 4A.

As further illustrated by FIGS. 4A and 4B, the position of retainer 33 is restrained by stop 20 on inner cylinder 1 and on the retainer 33 at features 21 and 21'. Such stops ensure that retainer 33 is positioned correctly for either of removal or installation, wherefore such stops are an integral part in the illustrated structures of the arrangement of exemplary pin tumbler lock constructions in accordance with the present technology, to the extent that such relate to removable core present embodiments. As should be apparent to those of ordinary skill in the art, the present technology provides a structure that reflects a significantly more simple design mechanically relative to previous designs that incorporated multiple driving rods or pins and levers to drive cross bolts and other elements to provide a removable core structure.

FIGS. 4A and 4B illustrate the components of the core assembly 100. The components are illustrated assembled in FIG. 4A while shown in an exploded view in FIG. 4B. As may be seen more clearly in FIG. 4B, a removable core pin tumbler lock constructed in accordance with the present technology may correspond to an inner cylinder 1 into which may be inserted a core (or plug) 2. Following insertion of core 2, a plurality of tumblers 4, driver pins 5 and springs 66 may be inserted into an appropriately provided hole or holes (such as hole 44) and secured by plate 12 in a manner well understood by those of ordinary skill in the art.

In accordance with the present technology, retainer 33 with its extension locking tab 3 may be secured to the rear portion of inner cylinder 1 and, at the same time, core 2 may be held in place within inner cylinder 1 by placement of snap ring 9 into groove 19 provided on the rear portion of core 2.

It should be appreciated by those of ordinary skill in the art that these assemblies can easily be bitted in many different codes and, likewise, can be easily re-keyed due to the provision of the above described features. It should be appreciated by those of ordinary skill in the art upon review of the presently described technology that various additional configurations of the removable core pin tumbler lock, and of non-removable present embodiments, may be constructed in accordance with the present technology. For example, a more secure core removal aspect (in the instance of a removable core arrangement) may include the use of two tumblers to lock the locking tab 3 in place as opposed to the single tumbler configuration herein illustrated.

With reference now to FIGS. 5A and 5B, there are illustrated respective front and back (and generally side) perspective views of an exemplary outer cylinder 500 into which a present exemplary core assembly may be installed in accordance with the present subject matter. Such exemplary outer cylinder 500 may in turn be mounted in a useful position, such as in a drawer or door to be secured.

As further represented by present FIG. 6, core assembly 100 may slide into the front of outer cylinder 500 when a removal or control key 8 (see FIG. 1) is inserted and used to turn the locking tab 3 on retainer 33 to line up with the tumbler block 110 of the inner cylinder 1. It should be appreciated by those of ordinary skill in the art that, as illustrated in such FIG. 6, core assembly 100 could not be inserted into outer cylinder 500 in such configuration since locking tab 3 has not yet been rotated to a position in line with tumbler block 110. Once a control key is inserted into core assembly 100 and the core retainer 33 and locking tab 3 are rotated (such as counter-clockwise from the position illustrated in FIG. 6), core assembly 100 may be seated in the outer cylinder 500. The control key may then be rotated clockwise to position locking tab 3 in the position illustrated in FIG. 6 to securely lock the core assembly 100 in the outer cylinder 500, after which the control key may be removed from the lock. A pass key 8 keyed to a newly inserted or replaced core assembly may then be used to gain access to the secured subject drawer or door (not illustrated) into which the lock assembly has been mounted. It is also to be recognized that presently disclosed structures and associated methodology help to reduce any susceptibility to unauthorized techniques practiced against the lock, such as involving unintentional activation of the tumbler using a key.

While the present subject matter has been described in detail with respect to specific embodiments thereof, it will be appreciated that those skilled in the art, upon attaining an understanding of the foregoing, may readily produce and/or practice alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A key operated removable core pin tumbler lock, comprising:

a core configured to receive first and second key types, said core provided with a first plurality of holes configured to receive pin tumblers;

a first cylinder configured to receive said core and provided with a second plurality of holes configured to receive pin tumblers, said second plurality of holes being equal in number and alignable with said first plurality of holes, said first cylinder comprising a first portion and a second portion, said second portion configured for limited rotation with respect to said first portion and provided with at least one hole of said second plurality of holes;

a locking tab extending from a portion of the second portion of said first cylinder;

at least one first tumbler positioned in selected of said plurality of holes in said first portion of said first cylinder, said at least one tumbler movable within its respective hole to a position establishing a first sheer line permitting unlocking of the lock; and at least one second tumbler positioned in said at least one hole of said plurality of holes in said second portion of said first cylinder;

wherein said at least one hole of said plurality of holes in said second portion of said first cylinder is configured such that said at least one second tumbler is maintained at said first sheer line in the absence of a key of the second key type; and whereby insertion of said first key type permits unlocking of the lock, and insertion of said second key type permits rotation of said second portion of said first cylinder with respect to said first portion of said first cylinder.

2. The lock of claim 1, further comprising:

a second cylinder configured to receive said first cylinder and said core, wherein insertion of said second key type permits rotation of said second portion of said first cylinder and selected insertion or removal of said first cylinder into or out of, respectively, said second cylinder.

3. The lock of claim 1, wherein said core has a front portion and a rear portion, said front portion configured to receive a key, and wherein said second portion of said first cylinder is positioned to receive said rear portion of said core.

4. A multiple key type actuated removable core pin tumbler lock assembly, comprising:

a core configured to receive first and second key types;

a first cylinder, said first cylinder comprising a first portion and a second portion, said first and second portions being rotatable relative to each other, and said core and said first cylinder defining respective pluralities of mutually alignable pin tumbler receiving holes;

a locking tab extending from a portion of said second portion of said first cylinder;

a second cylinder configured to retainably receive said first cylinder, wherein said second portion of said first cylinder forms at least one pin tumbler receiving hole thereof alignable with at least one pin tumbler receiving hole formed in said core;

at least one first tumbler positioned in selected of said plurality of mutually alignable pin tumbler receiving holes in said first portion of said first cylinder, said at least one tumbler movable within its respective hole to a position establishing a first sheer line permitting unlocking of the lock; and at least one second tumbler positioned in said at least one hole of said plurality of mutually alignable pin tumbler receiving holes in said second portion of said first cylinder;

wherein said at least one hole of said plurality of mutually alignable pin tumbler receiving holes in said second portion of said first cylinder is configured such that said at least one second tumbler is maintained at said first sheer line in the absence of a key of the second key type; and whereby insertion of said first key type into said core permits unlocking of the lock and insertion of said second key type into said core permits rotation of said locking tab.

5. The lock assembly of claim 4, wherein said core has a front portion and a rear portion, said front portion configured to receive a key, and wherein said second portion of said first cylinder is positioned to receive said rear portion of said core.

6. A method for providing a removable core lock, said method comprising the steps of:

providing a lock core;

providing a first cylinder comprising first and second portions;

providing a locking tab on a portion of the second portion;

configuring the second portion to be rotatable relative to the first portion;

inserting the lock core into the first cylinder;

providing a plurality of alignable tumbler receiving holes in the lock core and the first portion of the first cylinder;

providing at least one alignable hole in the lock core and the second portion of the first cylinder;

providing a first tumbler in selected of the plurality of alignable tumbler receiving holes in the lock core and the first portion of the first cylinder;

providing a second tumbler in the at least one alignable hole in the lock core and the second portion of the cylinder; and configuring the at least one alignable hole in the lock core to maintain the second tumbler at a position permitting unlocking of the lock absent insertion of a key.

7. The method of claim 6, further comprising:

providing a second cylinder;

configuring the second cylinder to receive the first cylinder;

rotating the second portion of the first cylinder and the locking tab in a first direction;

inserting the first cylinder into the second cylinder; and rotating the second portion of the first cylinder and the locking tab in a second direction opposite the first direction.

8. A key operated pin tumbler lock having a pin tumbler variable depth feature, for improved security against unauthorized access to operation thereof, said lock comprising:

a core forming a first plurality of holes configured to receive pin tumblers;

a first cylinder configured to receive said core and provided with a second plurality of holes configured to receive respective sets of paired pin tumblers and driver pin sets, said second plurality of holes being equal in number and alignable with said first plurality of holes;

a plurality of sets of paired pin tumblers and driver pin sets respectively received in said second plurality of holes; and a plurality of biasing springs received respectively in said second plurality of holes, and configured for driving said respective sets of paired pin tumblers and driver pin sets into said first plurality of holes when aligned with said second plurality of holes, with a sheer line being defined by the relative resting position of the meeting point between respective pin tumblers and driver pins of a given pair thereof;

wherein at least one hole of said first plurality of holes is formed to a predetermined depth selected such that the bottom of said corresponding pin tumbler is relatively displaced, so as to avoid contact of said corresponding pin tumbler with a key of a given type inserted into said lock.

9. The lock of claim 8, wherein said predetermined depth of said at least one hole is relatively more shallow than the depth of the other of said first plurality of holes.

10. The lock of claim 8, wherein the depth of a selected plurality of said first plurality of holes is predetermined such that the corresponding bottoms of associated pin tumblers are otherwise relatively displaced.

11. The lock of claim 8, further comprising a second cylinder configured to receive said first cylinder and said core.

12. The lock of claim 8, wherein:

said first cylinder comprises a first portion and a second portion, with said second portion configured for limited rotation with respect to said first portion and provided with at least one hole of said second plurality of holes; and said lock further includes a locking tab extending from a portion of said second portion of said first cylinder;

whereby insertion of a first key type permits unlocking of the lock, and insertion of a second key type permits rotation of said second portion of said first cylinder with respect to said first portion of said first cylinder.

13. The lock of claim 12, further comprising:

a second cylinder configured to receive said first cylinder and said core;

wherein insertion of said second key type permits rotation of said second portion of said first cylinder and selected insertion or removal of said first cylinder into or out of, respectively, said second cylinder.

14. The lock of claim 12, further comprising:

at least one first tumbler positioned in selected of said second plurality of holes in said first portion of said first cylinder, said at least one tumbler movable within its respective hole to a position establishing a first sheer line permitting unlocking of the lock, and at least one second tumbler positioned in said at least one hole of said second plurality of holes in said second portion of said first cylinder, wherein said at least one hole of said second plurality of holes in said second portion of said first cylinder is configured such that said at least one second tumbler is maintained at said first sheer line in the absence of a key of the second key type.

15. The lock of claim 12, wherein said core has a front portion and a rear portion, said front portion configured to receive a key, and wherein said second portion of said first cylinder is positioned to receive said rear portion of said core.

* * * * *